United States Patent [19]

Matsushita et al.

[11] 4,435,471

[45] Mar. 6, 1984

[54] TRANSFER-ONTO-PLAIN PAPER TYPE OF PRESSURE-SENSITIVE COPYING PAPER

[75] Inventors: Toshihiko Matsushita, Funabashi; Shigetoshi Hiraishi, Tokyo; Sadao Morishita, Ibaraki, all of Japan

[73] Assignee: Mitsubishi Paper Mills, Ltd., Tokyo, Japan

[21] Appl. No.: 387,145

[22] Filed: Jun. 10, 1982

[30] Foreign Application Priority Data

Jun. 17, 1981 [JP] Japan ..... 56-93219

[51] Int. Cl.[3] ..... B41M 5/16

[52] U.S. Cl. ..... 428/320.8; 282/27.5; 428/488; 428/537; 428/914

[58] Field of Search ..... 282/27.5; 427/150, 151, 427/152, 153; 428/320.8, 488, 537, 914, 211

[56] References Cited

U.S. PATENT DOCUMENTS

| | | | |
|---|---|---|---|
| 3,554,781 | 1/1971 | Matsukawa | 428/320.8 |
| 3,856,554 | 12/1974 | Jablonski et al. | 282/27.5 |
| 4,139,218 | 2/1979 | Davis et al. | 427/288 |
| 4,347,283 | 8/1982 | Hiraishi et al. | 428/320.8 |

FOREIGN PATENT DOCUMENTS

| | | | |
|---|---|---|---|
| 53-16728 | 6/1978 | Japan | 282/27.5 |

*Primary Examiner*—Bruce H. Hess

*Attorney, Agent, or Firm*—Cushman, Darby & Cushman

[57] ABSTRACT

Pressure-sensitive copying paper prepared by coating a substrate with a single layer containing a color forming reaction system comprising a metal compound and ligand and further containing a wax can reproduce a clear and fast image onto plain paper.

5 Claims, No Drawings

TRANSFER-ONTO-PLAIN PAPER TYPE OF PRESSURE-SENSITIVE COPYING PAPER

This invention relates to a transfer-onto-plain paper type of pressure-sensitive copying paper, useful for reproductive recording onto plain paper.

Pressure-sensitive copying paper hitherto known is of a separating type comprising in principle a top sheet and a bottom sheet. The former is prepared by dissolving a colorless electron donative color former in a nonvolatile oil or the like, preparing microcapsules containing the resulting color former-containing oil as the core material, and coating the back of support therewith. The latter is prepared by coating the front of support with a colorless electron attractive developer. When the top sheet and bottom sheet are superposed so that their respective coated faces confront with each other and a pressure is applied onto the face of the top sheet with a writing pen, typewriter, or the like, its colored image is obtained on the bottom sheet. There is another separating type of pressure-sensitive copying paper which utilizes the color formation due to a chelate forming reaction by use of a metal compound and ligand in place of said color former and developer. These pressure-sensitive copying papers are inconvenient in that combined use of top and bottom sheets is necessary for copying.

Besides these, there is known self-contained pressure-sensitive copying paper which is prepared by coating one surface of support with both a color former and a developer. With this type of pressure-sensitive copying paper, image formation is possible only on the coated face. It has been known that when superposed with plain paper to contact the coated face therewith and printed, self-contained pressure-sensitive copying paper forms an image only on the coated face, reproducing no image on the plain paper.

Among the various kinds of pressure-sensitive copying paper mentioned above, those making use of a color forming reaction system combining a colorless electron donative color former with a colorless electron attractive developer are poor in fastness to light, heat, or others, so that they cannot be used, for example, for important securities requiring the fastness.

A transfer-onto-plain paper type of pressure-sensitive copying paper of which one surface is coated with a metal compound and ligand has been disclosed in Japanese Patent Publication No. 16728/1978 and corresponding Jablonski U.S. Pat. No. 3,856,554. Said pressure-sensitive copying paper, utilizing a chelate color formation, is prepared by coating a substrate with a capsuled reagent (a metal compound or a ligand), and coating the resulting layer with a solution of another reagent in a solvent, so that it is under the restriction that the capsule wall must be made of a solvent resistant material, since a solvent is used as mentioned above. In addition, this copying paper has many advantages in operational and economical aspects since it requires two-ply coating.

The present inventors, as a result of studies made to eliminate the above-mentioned drawbacks, have succeeded in obtaining a transfer-onto-plain paper type of colorless pressure-sensitive copying paper excellent in plain paper-transferability and color forming properties, by coating the back of a substrate with a single layer containing a metal compound, ligand, and wax, both or either one of the metal compound and ligand being capsulated.

In order to present the undesired color formation due to a chelate forming reaction, both or either one of the metal compound and ligand is preferred to be capsulated.

When the coating does not contain a wax, the coloring density of images transferred onto plain paper is very low. Addition of a wax to the coating, according to this invention, results in an improved coloring density of the transferred images.

The reason for the low coloring density of images transferred in the case of the conventional transfer-onto-plain paper type of pressure-sensitive paper using merely a metal compound and ligand, is that the solvent flowing out of the capsules ruptured by applying pressure with a writing pen or typewriter is absorbed by the substrate of coated paper itself and this deteriorates the transferability. In contrast, this invention is free from such a drawback because the wax incorporated into the coating layer has a water-repelling or oil-repelling effect and the solvent from the ruptured capsules is hence favorably transferred to the plain paper, thereby resulting in an improved transferability. Reproduced images obtained with the copying paper of this invention are excellent in fastness since they are based on the color formation due to a chelate forming reaction of metal compound with a ligand.

Waxes available for the copying paper of this invention include animal waxes such as beeswax, spermaceti, china wax, and lanolin; vegetable waxes such as candelilla wax, carnauba wax, Japan wax, rice wax, and sugar cane wax; mineral waxes such as montan wax, ozokerite, ceresin, and lignite wax; petroleum waxes such as paraffin wax and microcrystalline wax; modified waxes such as montan wax derivatives, paraffin wax derivatives, and microcrystalline wax derivatives; hydrogenated waxes such as caster wax and opal wax; synthetic waxes such as low molecular weight polyethylene and its derivatives, acra wax, and distearyl ketone; saturated fatty acid amide waxes such as caproamide, caprylamide, pelargonamide, capramide, lauramide, tridecylamide, myristamide, stearamide, behenamide, and ethylenebisstearamide; unsaturated fatty acid amide waxes such as caproleamide, myristoleamide, oleamide, elaidamide, linoleamide, erucamide, ricinoleamide, and linolenamide; and mixtures of these waxes.

As examples of the combination of a metal compound with a ligand used for the copying paper of this invention, there may be cited water-soluble chelate forming systems disclosed in Japanese Patent Publication No. 23710/1968, such as those of ammonium metavanadate with tannic acid, ferric alum with tannic acid, a stable diazonium salt of 4-benzamide-2,5-diethoxyaniline with naphtol AS caustic soda, and copper sulfate with phthalonitrile.

While an oil-soluble chelate forming system comprising a metal compound and a ligand may also be used in this invention, the oil-soluble chelate forming systems of metal compounds and ligands include combinations of sodium vanadate, sodium metavanadate, etc. as metal compounds with aromatic hydroxy compounds such as protocatechuic acid, ethyl protocatechuate, gallic acid, ethyl gallate, dodecyl gallate, pyrogallol-4-carboxylic acid, pyrogalloltannin, and tannic acid as ligands, disclosed in Japanese Patent Publication No. 17889/1975; combinations of ferric naphthenate with zinc 0,0-diisopropyldithiophosphate, iron stearate with zinc dimethyldithiocarbamate, copper palmitate with a basic nitrogen compound, N,N-bis(2-octanoyloxyethyl)diethyldithiooxamide, cobalt naphtenate with a basic nitrogen compound, N-lauroyl-DL-glutamate, etc., disclosed in Japanese Patent Publication No. 43566/1974; combinations of vanadium salts such as vanadyl acetate, vanadium acetylacetonate and vanadyl acetylacetonate with gallic acid esters such as n-propyl gallate, n-butyl gallate, and n-octyl gallate, with alkylcatechols such as 4-tert-butylcatechol, 3,5-di-tert-butyl catechol, and 3,6-diisopropylacatechol, with 2,3-dihydroxynaphthalene, with 2,3,4-trihydroxyacetophenone, with pyrogallol, with thiocatechols such as 2,2'-thio-bis(p-cresol), with quercetin, and with halogenated catechols such as tetrachlorocatechol and tetrabromocatechol, disclosed in Japanese Patent Publication No. 6926/1979.

As mentioned above, both or either one of said metal compound and ligand is capsulated. Capsulations of these compounds, in the case of water-soluble chelate forming systems, are preferably carried out according to known interfacial polymerization methods described in Japanese Patent Publication Nos. 446/1967, 771/1967, and 2883/1967. In the case of oil-soluble chelate forming systems, their capsulations can be carried out by known methods such as the coacervation method, in situ method, and interfacial polymerization method.

In the production of the transfer-onto-plain paper type of pressure-sensitive copying paper of this invention, the coating color is applied onto all or part of the substrate surface by use of a flexo printer or a solvent coater when the coating color is an organic solvent base dispersion containing water-soluble chelate-forming components, and by use of a common coater such as an air-knife coater of a printer such as a flexo printer when the coating color is a water base dispersion containing oil-soluble chelate-forming components.

When the coating color is prepared, a modifier can be added for improving properties of the dispersion to meet the coater or printer employed. The modifiers include for instance, a thickner for keeping the viscosity at a constant value and a surfactant for improving the dispersibility; however, it is needless to say that the modifiers are not limited thereto.

For the support on which the coating layer is formed according to this invention, paper is used chiefly though other materials can also be used, including various kinds of nonwoven fabric, plastic films, synthetic papers, metallic foils, and further composite sheets combining these.

This invention will be illustrated in more detail with reference to the following Examples: In the Examples, "part" represents part by weight.

EXAMPLE 1

(1) A dispersion of microcapsules containing oil-soluble ligand was prepared as follow:

A ligand solution was prepared by dissolving 10 parts of 2-ethylhexyl gallate in 90 parts of dioctyl adipate, and was dispersed in 200 parts of a 5% ethylenemaleic anhydride copolymer aqueous solution to give an emulsion of average particle size 7μ and pH 4.0. After addition of 200 parts of an aqueous solution containing both 10 parts of urea and 2 parts of resorcinol and further addition of 25 parts of 37% formalin, the mixture was reacted at 55° C. for 3 hours. The resulting mixture was cooled and adjusted to pH 8.0, thus completing microcapsulation.

(2) A coating color was prepared from this microcapsule dispersion and a metal compound, ammonium vanadate. Its composition (solid contents) was as follows:

| | |
|---|---|
| 2-Ethylhexyl gallate-containing microcapsules | 50 parts |
| Ammonium vanadate | 2 parts |
| p-tert-Butylphenol-formaldehyde resin | 8 parts |
| Paraffin wax | 20 parts |
| Wheat starch | 40 parts |
| SBR latex | 20 parts |

The compounded product, made up into 25% water base coating color, was applied onto a paper sheet by means of a Meyer bar No. 16.

The coated paper was superposed with a plain paper so as to contact the coated face therewith, and was typed with an IBM electric typewriter. Thus, a distinct, black colored image could be reproduced on the plain paper.

COMPARATIVE EXAMPLE 1

A water base coating color of the same composition as that of Example 1 except for containing no paraffin wax was prepared and applied onto paper in the same manner. The same copying test with the IBM typewriter was conducted, but practically no black colored image was obtained on the plain paper.

EXAMPLE 2

(1) A dispersion of metal compound-containing microcapsules was prepared as follows:

A 10% copper sulfate aqueous solution (80 parts) containing 18 parts of tetraethylenepentamine dissolved was added in portions to a xylene solution of 20 parts of an epoxy resin and dispersed so as to form an emulsion of average particle size 7–8μ. The emulsion, after the predetermined average particle size had been obtained, was reacted with stirring for about 2 hours while keeping the liquid temperature at 30° C. Succeedingly, the temperature was raised to 60° C. and the reaction was continued for 5–6 hours to complete the microcapsulation.

(2) A coating color having the following composition (indicating dry solid contents) was prepared from the microcapsule dispersion obtained above and a ligand, phthalonitrile:

| | |
|---|---|
| Microcapsules containing the aqueous solution of copper sulfate | 50 parts |
| Phthalonitrile | 3 parts |
| Microcrystalline wax | 25 parts |

The coating color, 25% solids in xylene, was applied onto a paper sheet by means of the above-said Meyer bar No. 16. The same copying test as Example 1 gave a clear blue colored image reproduced on the plain paper.

COMPARATIVE EXAMPLE 2

The same coating color as prepared in Example 2 except for containing no microcrystalline wax was applied onto paper in the same manner. The same copying test on the resulting copying paper gave practically no image on plain paper except a blue colored image on the coated face of the copying paper.

EXAMPLE 3

(1) A dispersion of ligand-containing microcapsules was prepared as follows:

A solution of 10 parts of dodecyl gallate in 80 parts of polyoxypropylene glycol monoether was dispersed in 100 parts of a 5% aqueous solution of pH 4.0 containing a styrene-maleic anhydride copolymer and a small amount of sodium hydroxide. A mixture of 10 parts of melamine, 25 parts of 37% formalin, and 65 parts of water was adjusted to pH 9 by adding sodium hydroxide, and on heating to 60° C., became transparent after 15 minutes, giving a melamine-formaldehyde pre-condensation product. This pre-condensation product was added to the above emulsion, and the mixture was heated with stirring at 60° C., and was cooled to room temperature after 30 minutes where the formation of microcapsules had been ascertained.

(2) Microcapsulation of a metal compound was carried out in the same manner as the above (1).

A dispersion of microcapsules was prepared by using 8 parts of vanadosiloxane and 80 parts of dioctyl phthalate in place of 10 parts of dodecyl gallate and 80 parts of polyoxypropylene glycol monoether, respectively.

(3) A coating color of the following composition (indicating dry solid contents) was prepared from the above microcapsule dispersions obtained.

| | |
|---|---|
| Dodecyl gallate-containing microcapsules | 30 parts |
| Vanadosiloxane-containing microcapsules | 15 parts |
| Paraffin wax | 15 parts |
| Wheat starch | 20 parts |
| SBR latex | 15 parts |

This compounded product, made up into 25% water base coating, was applied onto a base paper sheet by means of the Meyar bar No. 16. The coated paper was superposed with a plain paper sheet so as to contact the coated face therewith, and was typed with the IBM electric typewriter. Thus, a distinct, black colored image could be reproduced on the plain paper.

COMPARATIVE EXAMPLE 3

The same coating color as prepared in Example 3 except for containing no paraffin wax was applied onto paper in the same manner. The same copying test on the resulting copying paper gave practically no image on plain paper except a black colored image on the coated face of the copying paper.

What is claimed is:

1. A transfer-onto-plain paper type of pressure-sensitive copying paper prepared by coating the back of a substrate with a single layer containing a chelate color forming reaction system comprising a chelate forming metal compound and ligand and further containing a wax, both of said metal compound and ligand being microencapsulated.

2. A transfer-onto-plain paper type of pressure-sensitive copying paper of claim 1, wherein the wax is selected from the group consisting of waxes of animal, vegetable, mineral, and petroleum, modified waxes, hydrogenated waxes, synthetic waxes, and saturated or unsaturated fatty acid amide waxes.

3. A transfer-onto-plain paper type of pressure-sensitive copying paper of claim 2, wherein the wax is a petroleum wax.

4. A transfer-onto-plain paper type of pressure-sensitive copying paper of claim 3, wherein the petroleum wax is paraffin wax or microcrystalline wax.

5. A transfer-onto-plain paper type of pressure-sensitive copying paper of claim 1, wherein the color forming reaction system consisting of a metal compound and ligand is water-soluble or oil-soluble.

* * * * *